US008334652B2

(12) United States Patent
Mueller et al.

(10) Patent No.: US 8,334,652 B2
(45) Date of Patent: Dec. 18, 2012

(54) HIGH-PRESSURE DISCHARGE LAMP FOR OPERATION WITH LONGITUDINAL ACOUSTIC MODULATION

(75) Inventors: Patrick Mueller, Karlsfeld (DE); Klaus Stockwald, Germering (DE); Herbert Weiss, Diedorf (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 12/996,049

(22) PCT Filed: May 28, 2009

(86) PCT No.: PCT/EP2009/056536

§ 371 (c)(1),
(2), (4) Date: Dec. 3, 2010

(87) PCT Pub. No.: WO2009/147058

PCT Pub. Date: Dec. 10, 2009

(65) Prior Publication Data

US 2011/0074286 A1 Mar. 31, 2011

(30) Foreign Application Priority Data

Jun. 3, 2008 (DE) ..... 10 2008 026 522

(51) Int. Cl.
*H01J 61/30* (2006.01)

(52) U.S. Cl. ..... 313/570; 313/623; 313/627

(58) Field of Classification Search ..... 313/623–627
See application file for complete search history.

(56) References Cited

U.S. PATENT DOCUMENTS

| | | | | |
|---|---|---|---|---|
| 5,424,609 | A | 6/1995 | Geven et al. | |
| 5,825,129 | A * | 10/1998 | Van der Leeuw et al. | 313/634 |
| 6,181,065 | B1 * | 1/2001 | Huettinger et al. | 313/625 |
| 6,400,100 | B1 | 6/2002 | Kramer | |
| 7,701,141 | B2 | 4/2010 | Stockwald et al. | |
| 7,728,499 | B2 * | 6/2010 | Singh et al. | 313/489 |
| 2005/0042967 | A1 | 2/2005 | Jackson et al. | |
| 2005/0194908 | A1 | 9/2005 | Dakin et al. | |
| 2006/0164016 | A1 * | 7/2006 | Rintamaki et al. | 313/638 |
| 2008/0315770 | A1 | 12/2008 | Jungst et al. | |

FOREIGN PATENT DOCUMENTS

| | | | |
|---|---|---|---|
| DE | 102006002261 | A1 | 7/2007 |
| EP | 1729324 | A2 | 12/2006 |
| JP | 6196131 | A | 7/1994 |
| JP | 10500533 | A | 1/1998 |
| WO | 2005029534 | A2 | 3/2005 |
| WO | 2005088675 | A1 | 9/2005 |

OTHER PUBLICATIONS

International Search Report dated Aug. 28, 2009 of PCT/EP2009/056536.

Computer-generated translation for JP 10500533 A; Jan. 13, 1998.

* cited by examiner

*Primary Examiner* — Tarcie Y Green

(57) ABSTRACT

A high-pressure discharge lamp may include an elongate ceramic discharge vessel, at the ends of which an electrode system with an electrode tip pointing towards the discharge is mounted in a seal, the seal being tubular, the discharge vessel having an aspect ratio of at least 1.5, the discharge vessel having a metal halide fill and a wall load of more than 25 W/cm$^2$, wherein the lamp is configured for operation with longitudinal acoustic modulation, the specific rated power of the entire outer surface area of the discharge vessel lying between 17 and 22 W/cm$^2$, while at the same time the wall load in a subregion of the surface area, which extends between the tips of the electrodes, lies in the range of between 28 and 40 W/cm$^2$.

11 Claims, 3 Drawing Sheets

HIGH-PRESSURE DISCHARGE LAMP FOR OPERATION WITH LONGITUDINAL ACOUSTIC MODULATION

RELATED APPLICATIONS

The present application is a national stage entry according to 35 U.S.C. §371 of PCT application No.: PCT/EP2009/056536 filed on May 28, 2009, which claims priority from German application No.: 10 2008 026 522.5 filed on June 3, 2008.

TECHNICAL FIELD

Various embodiments are based on a high-pressure discharge lamp. Such high-pressure discharge lamps are adapted for operation with acoustic resonances and normally have a metal halide fill.

BACKGROUND

WO 2005/088675 discloses a high-pressure discharge lamp with a ceramic discharge vessel, which has a metal halide fill, the metal halides NaI, TlI, $CaI_2$ and $REI_3$ being used besides Hg and Xe. Primarily Ce, Nd and/or Pr are employed as rare earth metals RE. The wall load should be at least 30 W/cm$^2$, expressed in terms of the region of the discharge length between the electrodes. This lamp is intended for automobile applications and is operated without acoustic resonance.

A similar high-pressure discharge lamp is presented in EP 1 729 324. Here, the possibility of resonant operation with longitudinal acoustic resonance is described in detail.

SUMMARY

Various embodiments provide a metal halide lamp, which is intended for operation with acoustic resonances and which is distinguished by high efficiency.

Essentially, ceramic discharge vessels with a metal halide fill are used for operation with acoustic resonances. In order to ensure a high efficiency, which lies in the range of between 120 and 150 lm/W, it has been found that the thermal conditions must expediently be improved. For different rated powers, to this end an acoustically induced convection, which scales according to particular rules with the surface area of the discharge vessel, must be driven in a controlled manner. In this way, new types of thermal conditions can be forced which bring the efficiency typically to levels of from 140 to 150 lm/W.

The aim is to achieve a stable multi-cell convection. This can be sustained over a large rated power range. To that end, it is crucial to establish regions with particular surface areas and comply with guidelines for this. One suitable parameter for this is the power density.

By describing the scaling laws for the ratios of surface areas in relation to the applicable rate power, ceramic discharge vessels can be configured for different power classes and luminous flux classes.

The invention expediently regulates the convection flow in the fill operated with acoustic modes. This flow would lead to an additional heat flux behind the electrode tip towards the end of the discharge vessel. That would entail heating of this end as well as the cold-spot. In order to counteract this heating, it is necessary to ensure effective end cooling so that the cold-spot and the end of the discharge vessel are not heated too greatly.

In order to be able to operate a metal halide lamp in the longitudinal acoustic mode, the geometry of the discharge vessel should have a so-called aspect ratio AV of at least 1.5. It preferably lies in the range of from 3.5 to 6, and in particular AV=4.5 to 5; an aspect ratio AV of from 4.6 to 4.8 is particularly suitable. The aspect ratio is the ratio between the inner length and the inner diameter of the discharge vessel. The discharge vessel has a longitudinal axis and is essentially cylindrical. It may also bulge slightly in the middle. An operating method for such lamps is disclosed, for example, in U.S. Pat. No. 6,400,100.

A discharge vessel which is cylindrical in relation to the inner volume is preferably used. It has an outer lateral face as well as outer end faces or at least oblique faces, which extend as far as the base points of tubular ends, often involving the use of capillaries. The outer lateral face plus the outer oblique end faces define a total outer surface area OSUM, excluding the capillaries or plugs. If the rated power P is expressed in terms of the total outer surface area OSUM, then it is found that the specific rated power PS=P/OSUM defined in this way must reach a value from 17 to 22 W/cm$^2$ for a high efficiency, while at the same time the wall load must also be kept high. It should reach at least 28 W/cm$^2$.

In order to understand the invention, the discharge vessel needs to be fictitiously divided transversely to the longitudinal axis into three sections. The boundary is in each case the tip of the electrode. The normal to the longitudinal axis, which intersects the tips, defines a hot arc section in which the discharge extends. It is relatively hot during operation. The wall load in the region of this hot section should preferably be in the range of from 28 to 40 W/cm$^2$. This outer surface area of the arc section will be denoted by OH.

The surface area of the ends lying behind, including oblique faces or end faces, which induce the cooling, will be denoted by OK. Since the discharge vessel has two ends, the surface area of both ends must be used. As a rule, the two ends are symmetrical so that each cooling surface area includes half of OK.

Cooling is particularly effective when the arc section, to which OH is assigned, reaches the high wall load W of at least 28 W/cm$^2$ during operation, while the total surface area OSUM, i.e. the sum of OH and OK, has the much lower specific rated power of from 17 to 22 W/cm$^2$. In other words, the surface area OK in the region of the ends must be sufficiently large. The ratio VH between OK and OH is preferably from 0.75 to 1.00. It preferably lies in the range VH=0.85 to 0.90. VH can be modified by technical measures such as coatings or increasing the surface area by means of ribs or fins in the region of OK.

For the thermal conditions, it is also favorable that the capillaries should not occupy too much space. A preferred value for the ratio VK between the total surface area OC of the two capillaries, including end faces, and the total surface area of the discharge vessel OSUM is VK=0.15 to 0.35. A value from 0.22 to 0.25 is preferred.

The wall thickness of the discharge vessel should preferably be dimensioned so that the specific rated power WI of the total inner wall area, which delimits the discharge volume, is from 30 to 42 W/cm$^2$. A value of from 38 to 41 W/cm$^2$ is preferred for WI.

Complying with such wall loads and specific rated powers makes it possible to achieve a suitable longitudinal temperature gradient TE of from 15.5 to 19 K/mm in the region of the discharge volume. This is intended to mean the temperature drop between the midpoint M, which lies centrally between the two electrodes, and the respective end point S of the discharge volume which is closed by an end face, the temperature being measured on the outside of the discharge vessel. The distance along the axial projection between M and S will be denoted as g.

The capillary should be designed so that the temperature gradient TK over the inner axial length L of the capillary is from 30 to 45 K/mm, in particular from 34 to 40 K/mm. This value is higher than in current lamps (at present less than 30 K/mm). It is achieved by making the end structure as short as possible.

With these dimensions, the following temperatures should be set up. In the middle of the discharge vessel it should be at most 1200° C., while at the end it should have dropped to at most 1080° C. at the point S. This should preferably lie in the range of from 1050 to 1070, a value below 1050° C. being most expedient.

This aspect is independent of whether the end design is made with an integral structure or plugs, etc.

A particular exemplary embodiment of the invention takes into account the fact that in order to support the cooling effect on the cooling end surface area, a coating transparent in the visible spectral range, and with increased NIR emissivity, is applied on at least some of the outer surface area OK of the discharge vessel. NIR means a range of from 0.8 and 3 μm (near infrared). The typical NIR emissivity $\epsilon$ of ceramics such as $Al_2O_3$ without a coating is about 0.1. The coating may extend over the entire end region, or merely a part of it. The emissivity $\epsilon$ may reach values of up to 0.8 in the case of graphite.

The long-wavelength IR radiation between 3 and 8 μm, on the other hand, is in part reflected by the envelope bulb and cannot serve for local cooling of surface regions. Nevertheless, the radiation in the range of up to 3 μm partially escapes through the glass of the outer bulb. The emissivity for this range can therefore be expediently improved with a coating, in order to support the cooling of the end region.

Any high temperature-resistant layer which is transparent in the visible spectral range is suitable as a coating, in particular graphite but also transparent conductive layers or multilayer coatings (for example $ZrO_2$/ITO (indium tin oxide)), the outermost layer being a conductive layer. Layers which are conductive, transparent and high temperature-resistant have the property of an emissivity corresponding to their internal electron plasma frequency. When a subsurface of the region to be cooled is coated, its emissivity increases. The cooling surface area at the end can therefore be reduced, specifically down to a value of 60% of the surface area without a coating.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
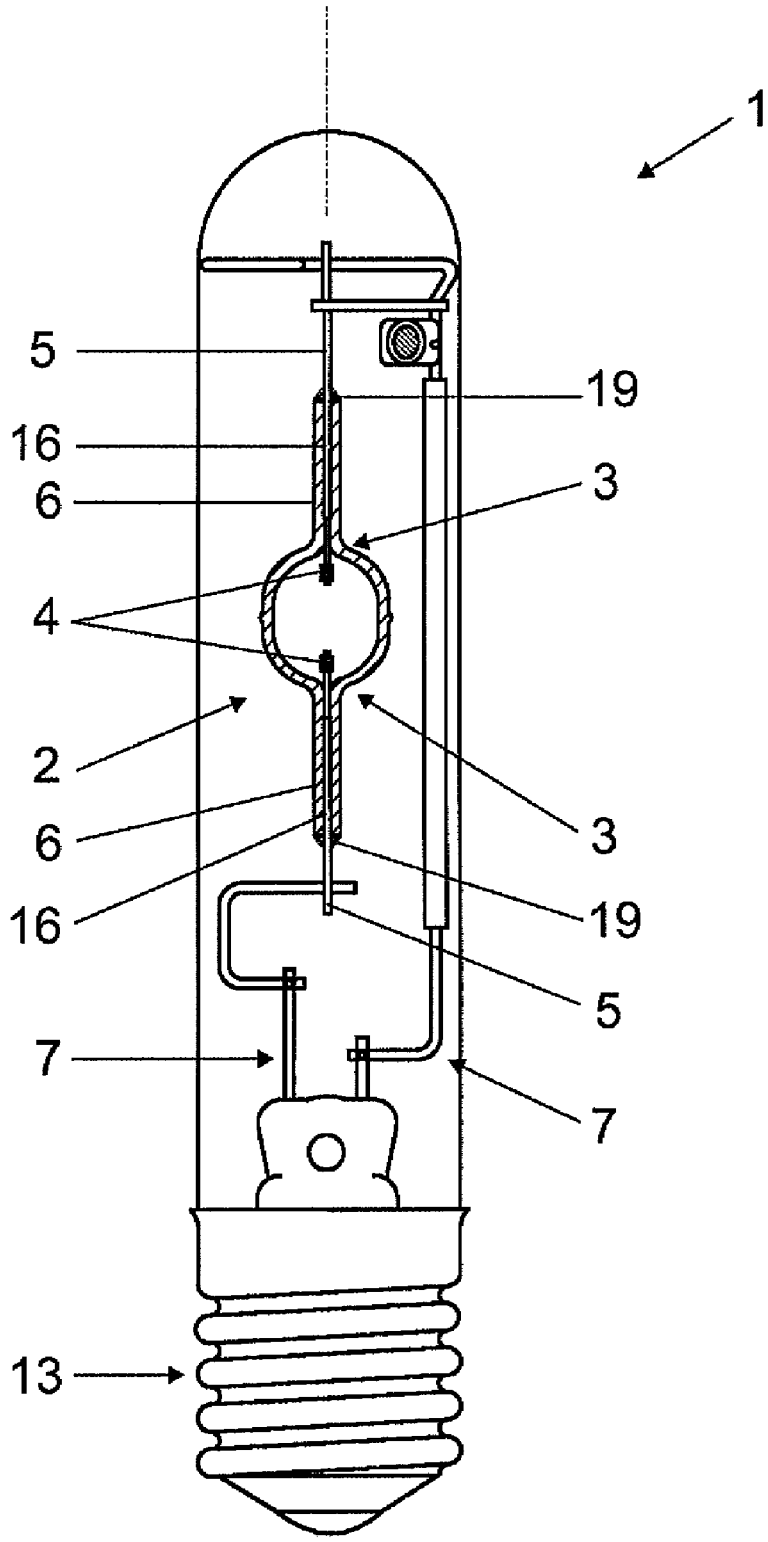
FIG. 1 shows a metal halide lamp having a ceramic discharge vessel.

An exemplary embodiment of a metal halide high-pressure discharge lamp 1 is shown by FIG. 1. It has a ceramic discharge vessel 2, which is closed on both sides. It is elongate and has two ends 3 with seals 6. Two electrodes 4 face each other inside the discharge vessel. The seals 6 are configured as capillaries, in which an electrode system 16 is sealed by means of glass solder 19. A supply lead 5, which is connected in a known fashion to the associated electrode 4, in each case protrudes from the capillary 6. This electrode is respectively connected via a frame 7 to a contact in the cap 13.

Metal halide fills which are known per se are suitable as a fill for the discharge vessel; in particular, the discharge vessel contains a fill of metal halides which is selected from the group consisting of the iodides of Na, Tl, Ca, rare earth metals (RE), individually or in combination. The system is suitable in particular for the following fill system: NaI, TlI, $CaI_2$ together with $REI_3$, RE being at least one of the elements Ce, Pr, Nd.

Figure 2:
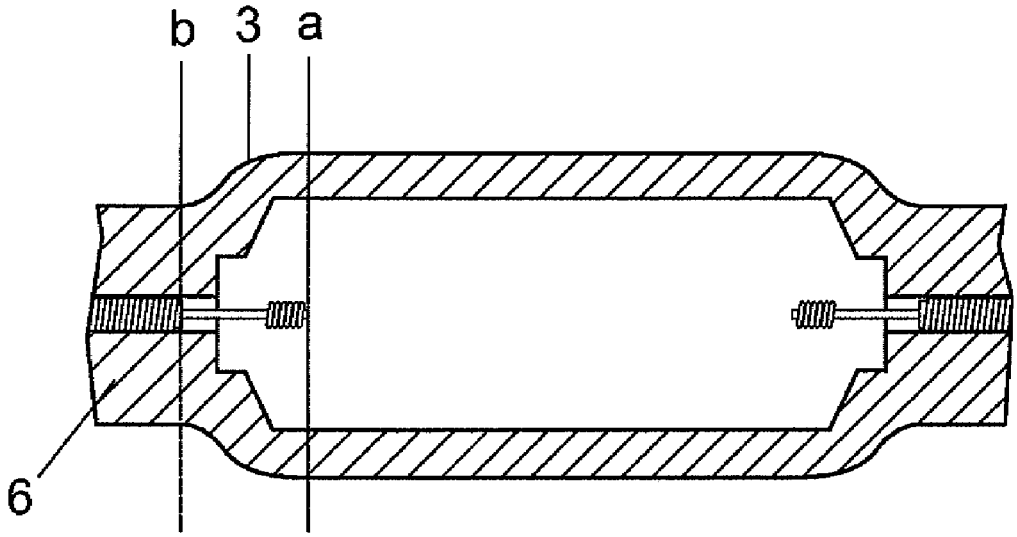
FIG. 2 shows the ceramic discharge vessel in section in detail.

FIG. 2 shows the end region in detail. The capillary 6 is integrally attached to the discharge volume. The end section begins level with the tip of the electrode (represented by dashes, line a) and extends as far as the point where the capillary reaches its constant diameter (line b).

Figure 3:
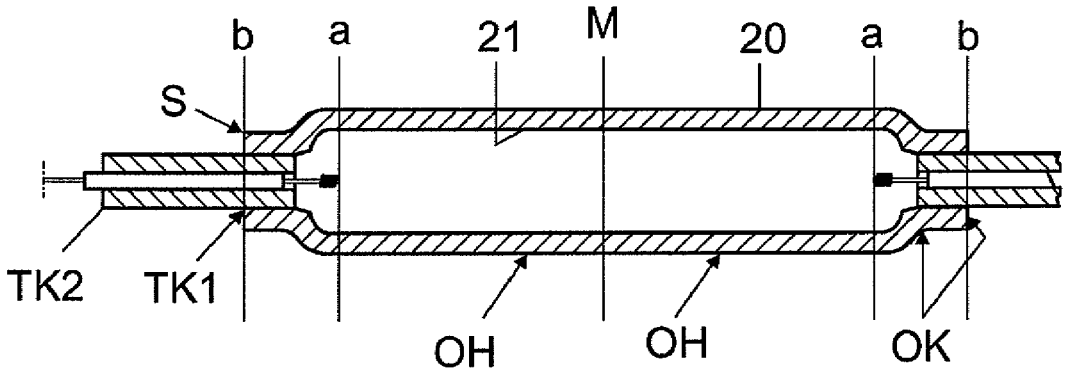
FIG. 3 shows a representation of the relevant parameters on the discharge vessel.

FIG. 3 shows an exemplary embodiment in which the discharge vessel is a cylindrical tube 20 with an aspect ratio of approximately 4.7. At the slightly tapered end, a plug 6 is fitted into the tube opening of the end and sealed by means of glass solder. The rated power is 70 W. The total wall load is 19.5 W/cm$^2$. The wall load in the region between the tips of the electrodes (between the two lines a) is 34 W/cm$^2$. The ratio between the cooled surface area (behind the tip of the discharge vessel, including the end face at line b) and the heated surface area (between the two lines a) between the electrodes is approximately 85% here. The ratio between the total surface area of the capillaries and that of the discharge vessel is from 22 to 25%. The wall load on the inner surface 21 (total) is 39.5 W/cm$^2$.

The gradient of the temperature (measured on the outside of the discharge vessel) between the middle M of the discharge vessel (exactly between the two electrode tips) and the point S on the outside of the end face, which seals the discharge vessel, is from 15.5 to 19 K/mm. As high as possible a value of between 17.5 and 18.5 K/mm is preferred. Conversely, a currently conventional value is between 12 and 15 K/mm.

Similarly, for the temperature gradient TK along the capillary, between the point TK1 where the capillary begins (as seen externally) and the end TK2 of the capillary, a temperature gradient of from 34 to 41 K/mm should be achieved. As high as possible a value of between 39 and 41 K/mm is preferred. Conversely, a currently conventional value is between 27 and 28 K/mm.

The ratio between the cooled and heated outer surface areas OK and OH of the discharge vessel should normally, i.e. when uncoated, lie in the range of from 75 to 100%. When an NIR-emissive coating is used, the area of the cooled end may be selected to be correspondingly less, down to 60% of the value without a coating.

Figure 4:
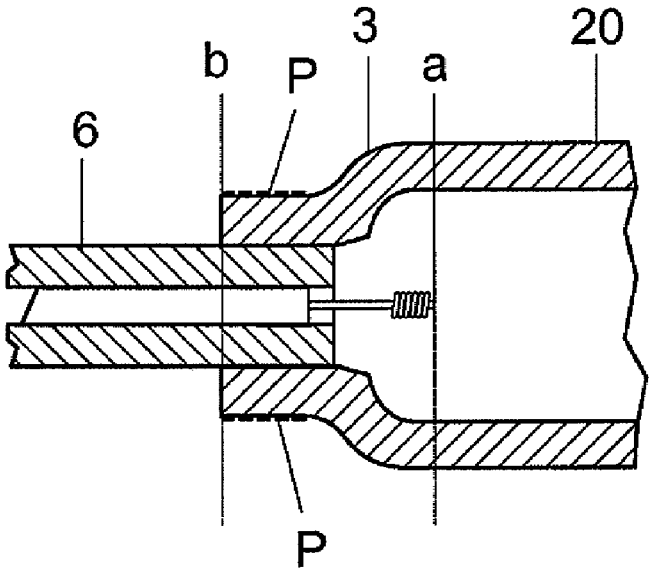
FIG. 4 shows an alternative for the end region with a coating.

FIG. 4 shows an exemplary embodiment in which the surface area of the end 3 is partially coated in the region of P.

The ratios above apply primarily for $Al_2O_3$ ceramic. In the case of other ceramics such as AlN, or sapphire, or mixed systems, similar conditions still apply.

In the case of a coating, the value of the ratio of OK to OH may be reduced by up to 20%. Overall, a value of from 60 to 100% is recommendable. When uncoated, a value of from 75 to 100% should be complied with if possible. Depending on the level and extent of the coating and material, it may be reduced down to 60%.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

Additionally, please cancel the originally-filed Abstract of the Disclosure, and add the accompanying new Abstract of the Disclosure which appears on a separate sheet in the Appendix.

The invention claimed is:

1. A high-pressure discharge lamp, comprising:

an elongated ceramic discharge vessel, at the ends of which an electrode system with an electrode tip pointing towards the discharge is mounted in a seal, the seal being tubular, the discharge vessel having an aspect ratio of at least 1.5, the discharge vessel having a metal halide fill and a wall load, expressed in terms of the region of the discharge length between the electrodes, of more than 25 W/cm$^2$, wherein the lamp is configured for operation with longitudinal acoustic modulation, and wherein the specific rated power, which is the rated power expressed in terms of the entire outer surface area of the discharge vessel lies between 17 and 22 W/cm$^2$, the entire outer surface area of the discharge vessel comprising a hot subregion of the surface area and a subregion of the surface area which induces cooling, and wherein the wall load in the hot subregion of the surface area, which extends between the tips of the electrodes, lies in the range of between 28 and 40 W/cm$^2$.

2. The high-pressure discharge lamp as claimed in claim 1, wherein the ratio between the subregion of the surface area that induces the cooling and the hot subregion of the surface area, is preferably from 0.6 to 1.00.

3. The high-pressure discharge lamp as claimed in claim 1, wherein the ratio between the surface area of two capillaries of the tubular seals and the surface area of the discharge vessel lies between 15 and 35%.

4. The high-pressure discharge lamp as claimed in claim 1, wherein the specific rated power of the entire inner surface area of the discharge vessel lies between 30 and 42 W/cm$^2$.

5. The high-pressure discharge lamp as claimed in claim 1, wherein the temperature gradient between the middle of the discharge vessel and a point at the level of the end face is from 15.5 to 19 K/mm.

6. The high-pressure discharge lamp as claimed in claim 1, wherein the temperature gradient between the base point of a capillary and the end point of the capillary lies between 34 and 41 K/mm.

7. The high-pressure discharge lamp as claimed in claim 1, wherein at least a part of the surface area of the end region is coated with an NIR coating or provided with a structure increasing the surface area.

8. The high-pressure discharge lamp as claimed in claim 1, wherein the discharge vessel contains a fill of metal halides, which is selected from the group consisting of the iodides of Na, Tl, Ca, rare earth metals, individually or in combination.

9. The high-pressure discharge lamp as claimed in claim 1, wherein the seal comprises a capillary.

10. The high-pressure discharge lamp as claimed in claim 2, wherein the ratio between the subregion of the surface area that induces the cooling and the hot subregion of the surface area, is preferably from 0.75 to 1.00.

11. The high-pressure discharge lamp as claimed in claim 7, wherein the structure increasing the surface area comprises fins and ribs.

* * * * *

UNITED STATES PATENT AND TRADEMARK OFFICE

CERTIFICATE OF CORRECTION

PATENT NO. : 8,334,652 B2
APPLICATION NO. : 12/996049
DATED : December 18, 2012
INVENTOR(S) : Mueller et al.

It is certified that error appears in the above-identified patent and that said Letters Patent is hereby corrected as shown below:

In the Specification

In column 5, lines 19 to 22: Cancel superfluous paragraph "Additionally, please ... Appendix."

Signed and Sealed this
Twenty-ninth Day of April, 2014

Michelle K. Lee

Michelle K. Lee
*Deputy Director of the United States Patent and Trademark Office*